US008807828B2

(12) United States Patent
Kury

(10) Patent No.: US 8,807,828 B2
(45) Date of Patent: Aug. 19, 2014

(54) TIMEPIECE

(75) Inventor: Patrick Kury, Langendorf (CH)

(73) Assignee: Eterna SA Fabrique d'horlogerie, Grenchen (CH)

( * ) Notice: Subject to any disclaimer, the term of this patent is extended or adjusted under 35 U.S.C. 154(b) by 15 days.

(21) Appl. No.: 13/643,370

(22) PCT Filed: Apr. 26, 2011

(86) PCT No.: PCT/EP2011/056585

§ 371 (c)(1),
(2), (4) Date: Oct. 25, 2012

(87) PCT Pub. No.: WO2011/134960

PCT Pub. Date: Nov. 3, 2011

(65) Prior Publication Data

US 2013/0039155 A1 Feb. 14, 2013

(30) Foreign Application Priority Data

Apr. 26, 2010 (CH) ..... 0603/10

(51) Int. Cl.
*G04B 1/10* (2006.01)
*G04B 1/16* (2006.01)
*G04B 31/012* (2006.01)

(52) U.S. Cl.
CPC ..... *G04B 1/16* (2013.01); *G04B 31/0123* (2013.01)
USPC ..... 368/143; 368/324

(58) Field of Classification Search
USPC ..... 368/142–145, 324–326
See application file for complete search history.

(56) References Cited

U.S. PATENT DOCUMENTS

| | | | | |
|---|---|---|---|---|
| 808,176 | A * | 12/1905 | Thalofer | 368/143 |
| 3,974,639 | A | 8/1976 | Gilomen et al. | |
| 4,132,061 | A | 1/1979 | Mathys | |
| 5,278,807 | A * | 1/1994 | Mathys | 368/140 |
| 6,651,633 | B1 * | 11/2003 | Jones | 123/559.1 |
| 7,942,573 | B2 * | 5/2011 | Kury | 368/142 |
| 2010/0322039 | A1 | 12/2010 | Kury | |

FOREIGN PATENT DOCUMENTS

| | | |
|---|---|---|
| CH | 610 178 | 4/1979 |
| CH | 700 673 | 9/2010 |
| FR | 2287717 | 5/1976 |
| GB | 955 499 | 4/1964 |
| WO | 2008/046750 | 4/2008 |

OTHER PUBLICATIONS

International Search Report dated Sep. 2, 2011, corresponding to PCT/EP2011/056585.

* cited by examiner

*Primary Examiner* — Sean Kayes
(74) *Attorney, Agent, or Firm* — Young & Thompson

(57) ABSTRACT

A timepiece includes: —a barrel bridge (33), and—a barrel mounted on the barrel bridge, the barrel having: —a drum (20) which includes an end wall and side walls, —an arbor (14) which passes through the center of the drum, —a leaf spring housed in the drum and engaging at a first end with the arbor and at a second end with the drum, and—a cover (28) through which the arbor passes freely and which closes the drum, —a ratchet wheel (30) secured to the arbor to tension the leaf spring. The drum is pivoted by a first ball bearing including an intermediate ring (36), an inner ring (42) secured to the arbor and an outer ring (38), one of the intermediate ring and the outer ring being fixed to the barrel bridge and the other being secured to the end wall.

15 Claims, 5 Drawing Sheets

TIMEPIECE

TECHNICAL FIELD

The present invention relates to the field of mechanical horology, and more particularly relates to a timepiece whereof the barrel is arranged in an advantageous manner.

The barrel is the driving organ used in mechanical watches. It acts as an energy accumulator wound by the user or by an oscillating weight and gradually restoring the energy it has stored to the train of the watch.

BACKGROUND OF THE INVENTION

A conventional barrel comprises:

- a barrel drum, which is a sort of cylindrical box having a bottom and side walls, the drum being provided with an outer toothing to drive the train,
- a barrel arbor pivoting between a bridge and a plate and provided with a hook arranged on its core,
- a strip-spring fastened by a first end to a countersink formed on the inner diameter of the side walls of the drum, and by a second end to the hook of the barrel arbor, and
- a cover closing the drum.

The drum and the cover generally serve to pivot the barrel arbor so as to stabilize the latter part. A ratchet is mounted secured to the barrel arbor, generally by a double squared connection. It is driven by a manual or automatic winding device to pivot the arbor and wind the barrel spring.

One skilled in the art knows that one of the primary factors in improving the efficiency of a movement is the quality of the pivoting of the various elements and the weakness of the friction involved. This point is particularly essential in the barrel, where the forces exerted are significant and defects in the guiding of the arbor and the drum may have non-negligible consequences for the power reserve.

Document CH 610178 proposes, with the goal of improving the pivot quality of the barrel, winding it cantilevered using a ball bearing. The ball bearing is driven into the inner ring of said bearing, while the outer ring is fastened in a bed formed in the plate. Furthermore, the drum is pivoted from the outside using runners with which it cooperates.

However, the presence of runners is particularly bothersome in terms of the bulk they create. Furthermore, experience shows that the precision of the device proposed in the aforementioned document is not very satisfactory. The present invention aims not only to offset this drawback, but also to improve the pivoting of the barrel.

BRIEF DESCRIPTION OF THE INVENTION

More specifically, according to the invention, the drum is pivoted by a first ball bearing having an inner ring secured to the arbor, an intermediate ring, and an outer ring, one of the intermediate and outer rings being fastened to the barrel bridge, the other being secured to said bottom.

According to another aspect, the invention also relates to a barrel whereof the arbor is mounted flying, i.e. it is only pivoted by one of its ends, using a bearing having three co-planar rings, whereof one ring among the intermediate and outer rings is fastened to an element of the frame (bridge or plate), the other ring among the intermediate and outer rings is fastened to the bottom of the drum, and the inner ring is fastened to the arbor.

BRIEF DESCRIPTION OF THE DRAWINGS

Other details will appear more clearly upon reading the following description, done in reference to the appended drawings, in which.

DETAILED DESCRIPTION OF THE INVENTION

Figure 1:
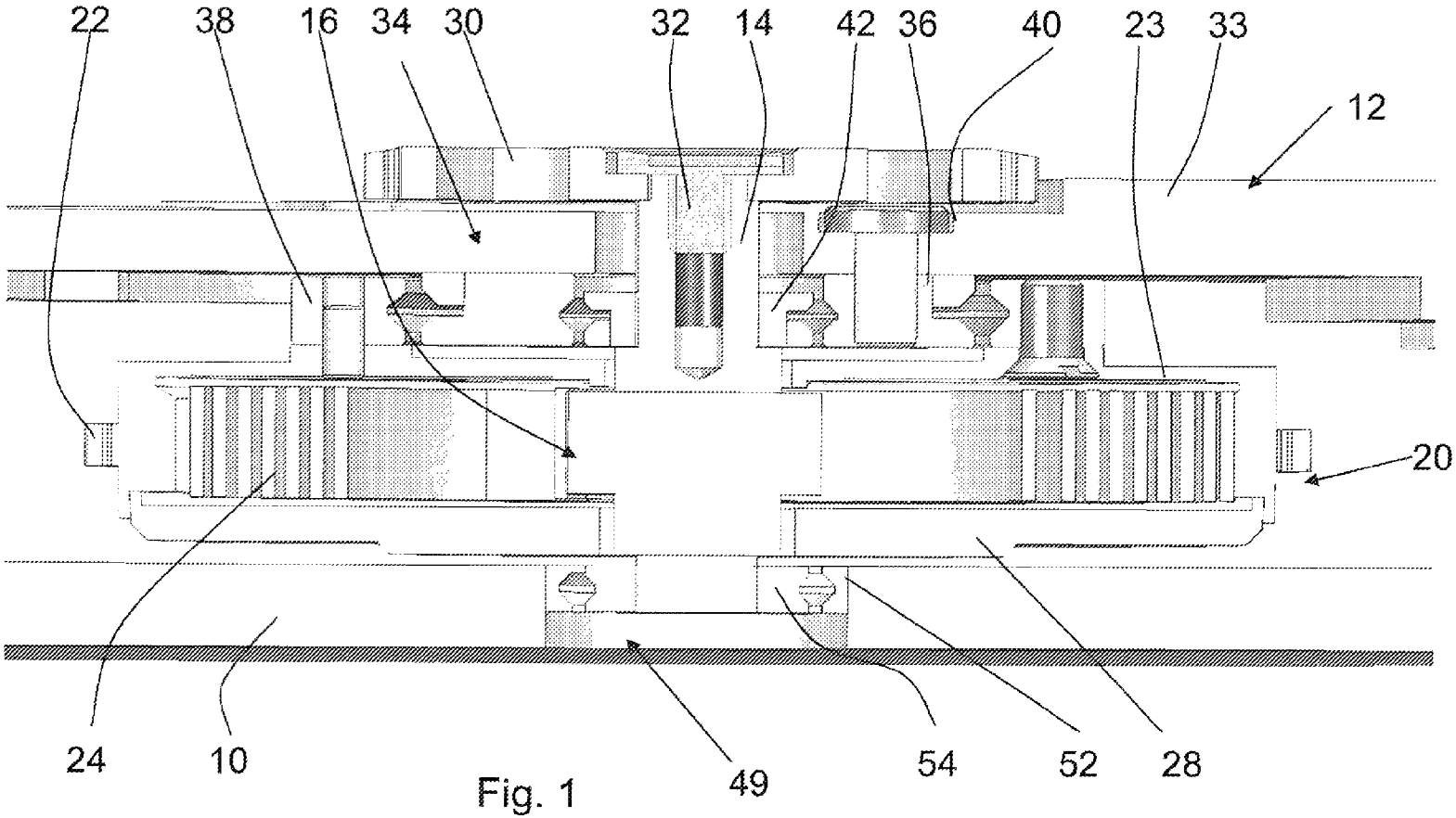
FIGS. 1 to 5 show different variants of the invention in cross-section.

FIG. 1 shows a plate 10 supporting the essential elements of a clockwork movement, only the energy accumulator of which is shown. The latter is traditionally made up of a barrel 12 comprising an arbor 14 provided with pivot means on the plate 10. The body of the arbor 14 defines a core 16 provided with a hook (not shown).

The arbor 14 passes through the center of a drum 20. The drum is provided with an outer toothing 22 to drive a train of a watch. It comprises a bottom 23 and side walls forming its diameter, which define a bed. A countersink is formed inside the side walls. The drum 20 is flying to pivot in relation to the arbor 14.

A strip-spring 24 is arranged in the bed, fastened by a first end to the hook and by a second end to the drum, at the countersink.

A cover 28 closes the drum 20. The arbor 14 also passes through the center of said cover, the arbor and the cover being flying in reference to one another.

A ratchet wheel 30 is mounted secured to the arbor 14, for example using a screw 32. This wheel is designed to be driven by winding means known by those skilled in the art in order to wind the strip-spring.

A barrel bridge 33 is rigidly mounted on the plate, to allow the arbor 14 to pivot. The ratchet wheel 30 tops the bridge 33 and is screwed into the arbor 14. It may also be arranged at the other end of the arbor 14.

According to one important aspect of the invention, the bottom of the drum 23 is situated on the side of the barrel bridge 33. In this way, the drum 20 is pivoted, by means of its bottom 23, on the barrel bridge 33 using a ball bearing 34. According to the embodiment illustrated in FIG. 1, said ball bearing comprises:

- an intermediate ring 36 fastened to the barrel bridge 33, for example by screwing as shown in the figure, and
- an outer ring 38 made integral with the bottom 23 of the drum by screwing, also shown in the figure, and
- an inner ring 42 made integral with the arbor 14, for example by driving or screwing.

Advantageously, the bottom 23 may have a slight overthickness in order to reinforce it at the screw passage. Furthermore, this overthickness makes it possible to define slight play between the bottom 23 and the other elements of the bearing, preventing any superfluous friction. The heads of the screws fastening the intermediate ring may be placed in a recess 40 formed in the barrel bridge 33.

The bearing 34 therefore comprises an inner ring 42 provided with a circular central hole, in which the arbor 14 is designed to be placed. The rings of the bearing are configured so as to have bearing surfaces for the balls, these not needing to be outlined here. Bows may complete the rings so as to define the rolling path of the balls completely.

Of course, in light of the dimensions of a timepiece barrel 12, the bearings used are micro-bearings, the precision of which must be maximal so as to guarantee perfect positioning of the pivot axes and optimal guiding of the moving parts.

It will be noted that, according to the invention, the barrel bridge 33 has an opening for the flying passage of the arbor. In light of the presence of the bearing as described above, there is no need to form a bearing block for the pivoting of the arbor at the barrel bridge 33. Such a bearing block is also not useful at the bottom 23.

There is also no need for other peripheral guide means, which flyings up the entire space around the barrel for other moving parts. Furthermore, the fact that the intermediate ring 36, which makes up the connecting part to the barrel bridge 33 and therefore the reference element for the pivoting of the arbor 14 and the drum 20, has a relatively large diameter, in any event larger than if those elements were pivoted directly at their pivot axis, gives the movement of said elements better stability and greater precision. This is beneficial not only for the pivoting of the drum 20, but also for that of the arbor 14, which bears stresses much better than the barrel arbors of the state of the art, which are also pivoted by a ball bearing, but that is arranged directly at the center thereof. The efficiency obtained with a barrel as described above is substantially improved in relation to the barrels of the state of the art.

In the embodiment illustrated in FIG. 1, the barrel arbor 14 is not mounted cantilevered. Its end situated on the side of the plate 10 is pivoted by a second ball bearing 49 arranged in the plate. Traditionally, this bearing 49 comprises a first outer ring 52 driven into the plate and a second inner ring 54 secured to the arbor 14.

Figure 2:
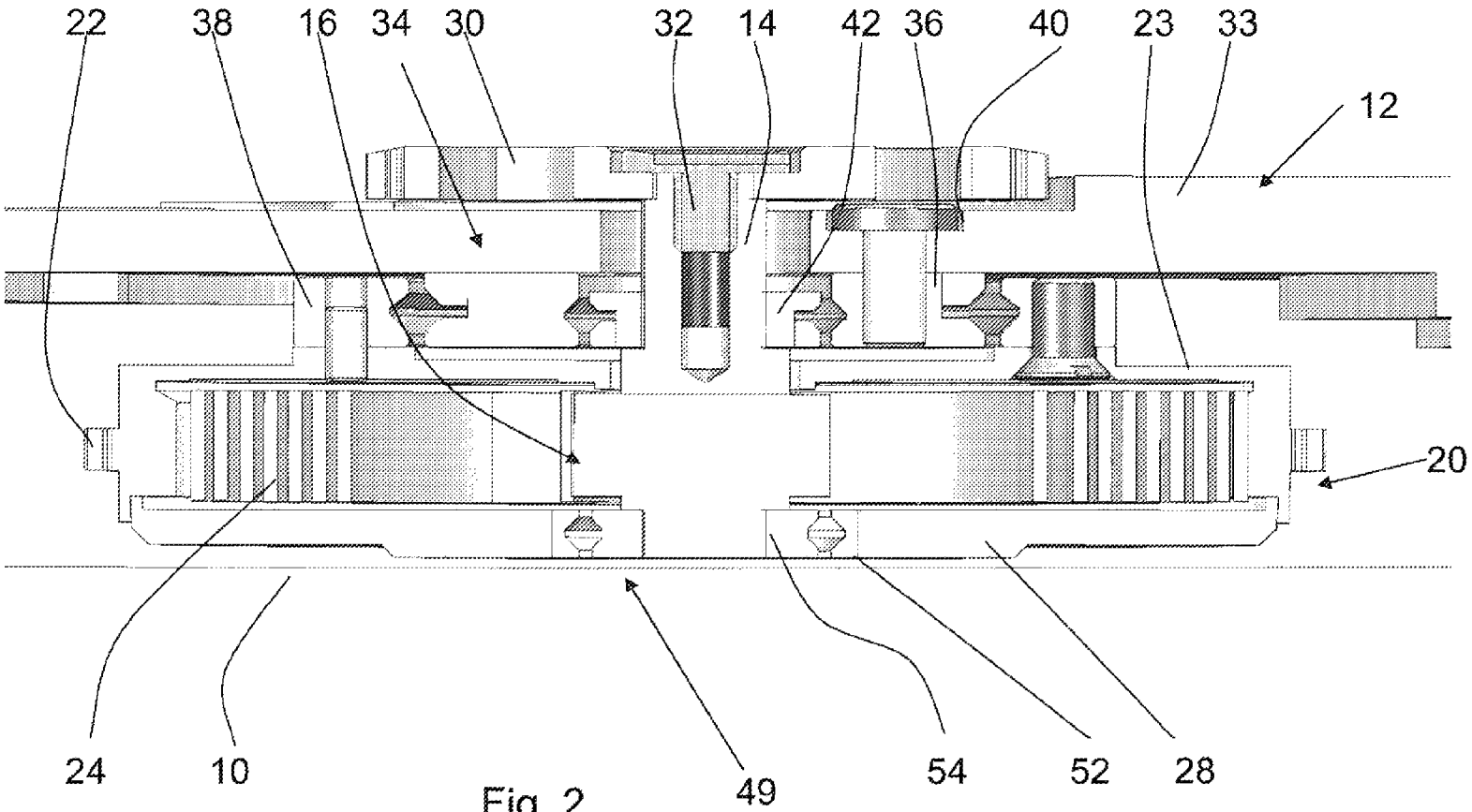

According to a first variant illustrated in FIG. 2, the second bearing 49 is directly housed in the cover of the drum 20, which makes it possible to decrease the thickness of the assembly. The barrel arbor 14 is no longer pivoted in the plate, but pivots in reference to the cover 28.

Figure 3:
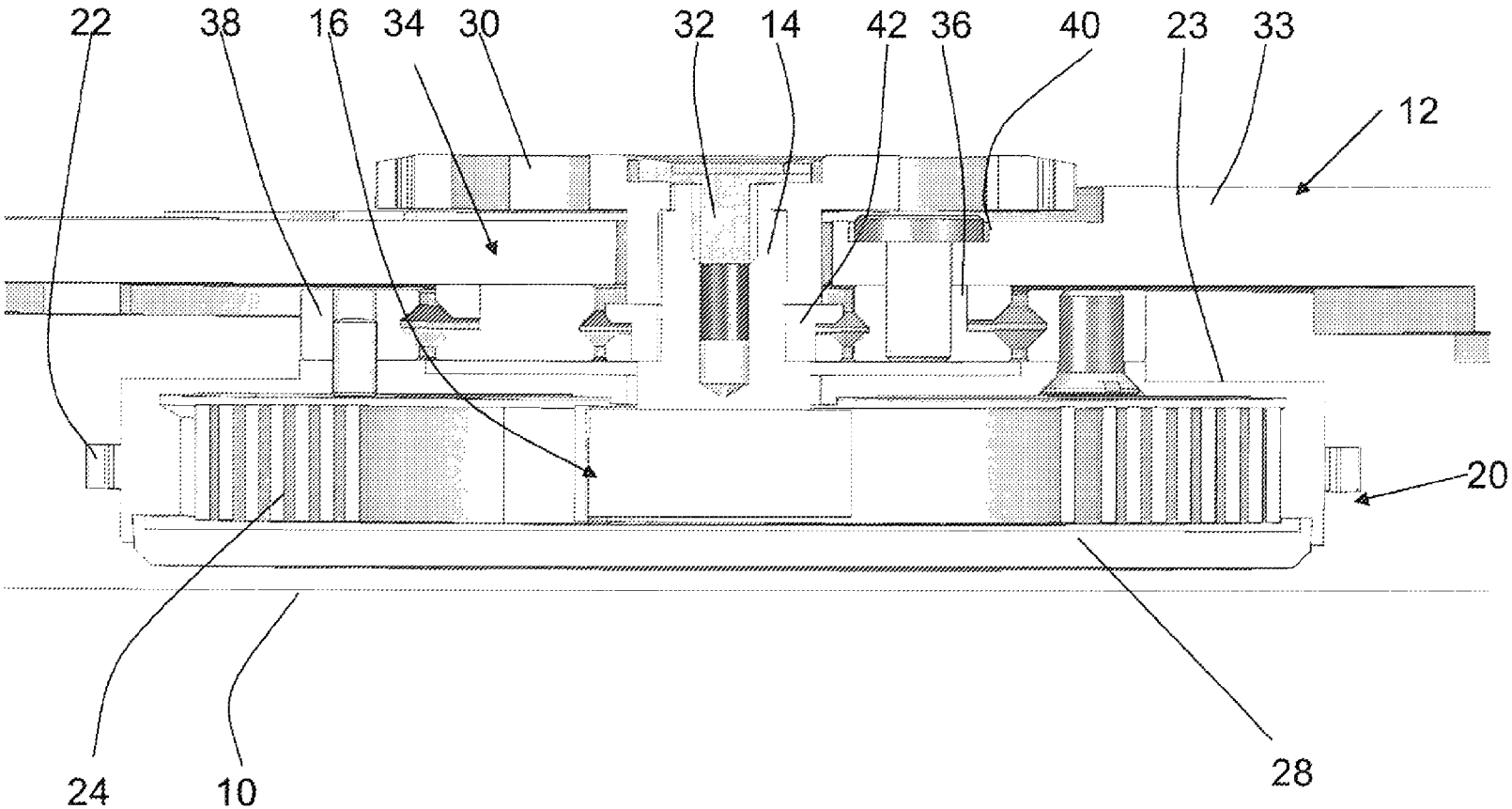

In a second variant proposed in FIG. 3, the barrel arbor 14 is mounted completely flying. In other words, the barrel arbor is only pivoted on the barrel bridge 33 and is not pivoted in reference to the plate or the cover 28 of the drum. The barrel arbor may be shortened, and the thickness of the cover of the barrel may be reduced, making the assembly even thinner. It is even possible to completely eliminate the cover of the barrel. This construction is particularly advantageous, as it makes it possible to assemble the barrel on the barrel bridge independently of the assembly of the other parts of the movement. The operations for mounting the movement are thus made easier. Furthermore, it is possible to mount either the arbor or the bottom of the barrel on the bridge and to disassemble them from the bridge, without having to completely disassemble the entire barrel, on the condition that the bottom opening for the passage of the arbor is larger than the outer diameter of the arm.

Although the proposed embodiments show, for the bearing 34, that the intermediate ring 36 is fastened to the barrel bridge 33 and the outer ring 38, at the bottom 23 of the barrel, this construction may be inverted. Thus, it is possible, without going beyond the scope of the invention, to fasten the intermediate ring 36 to the bottom 23 of the barrel and the outer ring 38 to the barrel bridge 33.

Furthermore, regarding the variant of FIG. 3, it is also advantageously possible to consider mounting the barrel flying on the plate. It has in fact been observed that, owing to the stability imparted by the bearing as proposed by the invention, it is possible to do away with pivoting of the barrel arbor by the two ends thereof. The barrel arbor is then only pivoted on the plate, no pivoting being provided at the cover.

Figure 4:
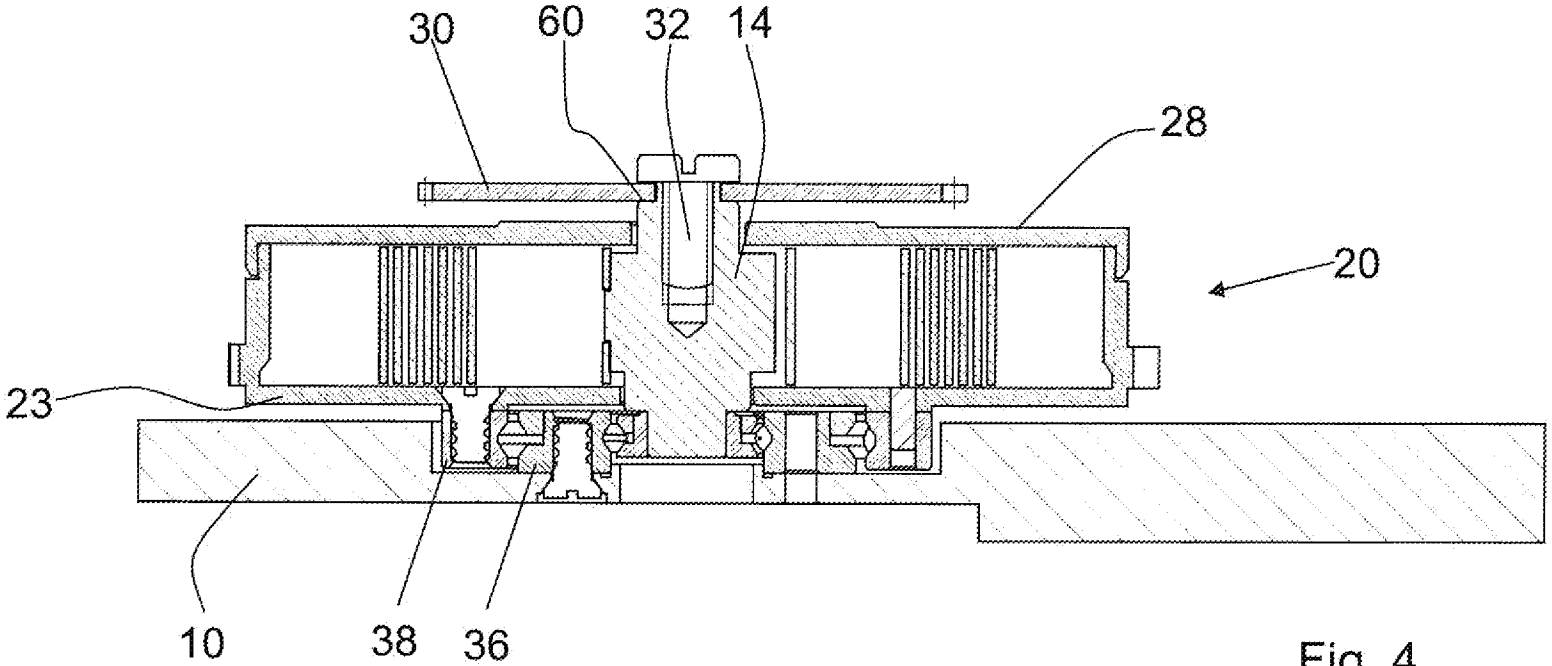

Thus, as proposed in FIG. 4, it is possible to eliminate the barrel bridge and save the corresponding thickness. To mount the ratchet wheel 30 on the arbor, in the absence of a bridge, it is possible to provide a small crosspiece or a slight shoulder 60 on the barrel arbor to position the ratchet wheel heightwise.

Figure 5:
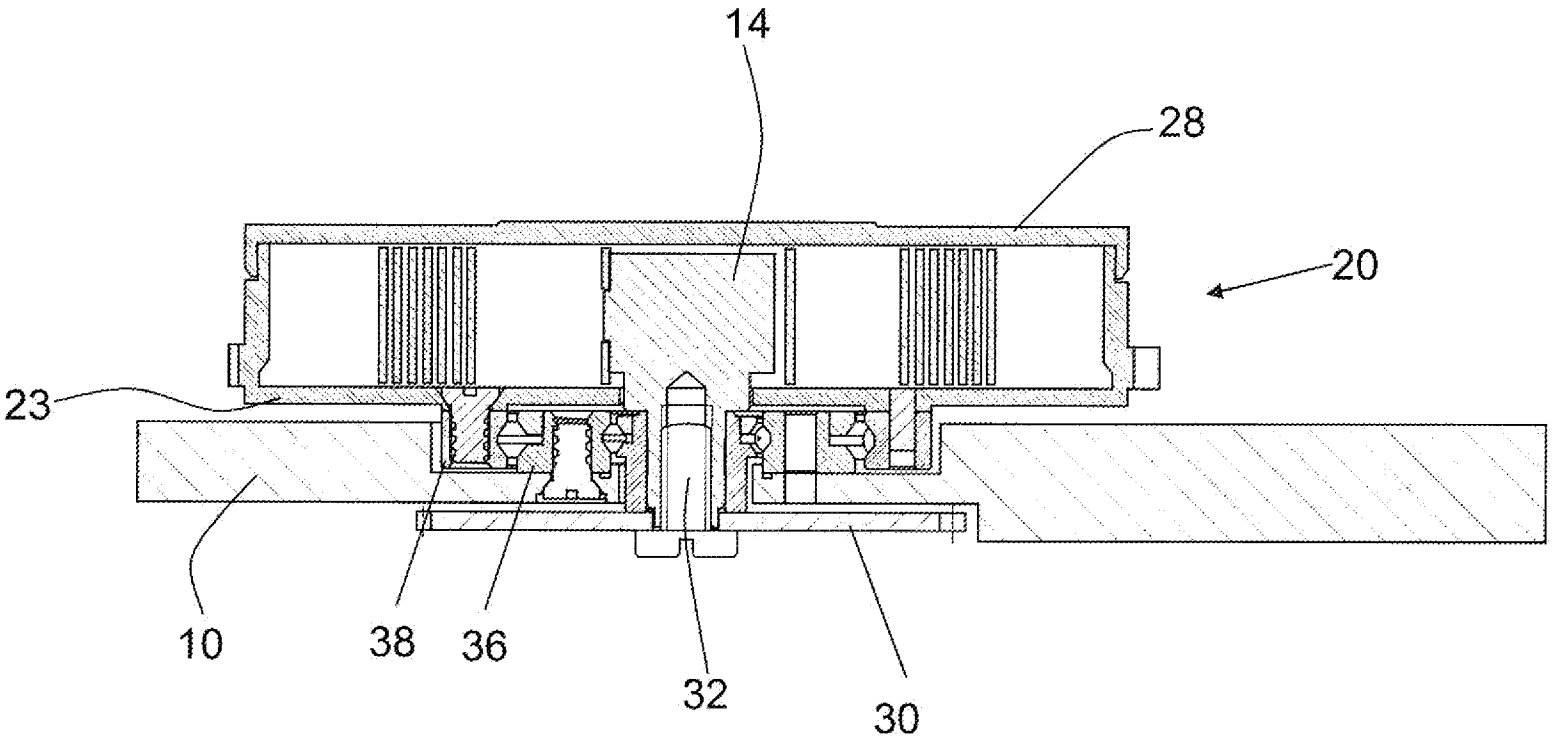

By adapting the construction of the movement, it is also possible to mount the ratchet wheel 30 on the plate side. In FIG. 5, the ratchet wheel is mounted on the surface of the plate 10 opposite that which receives the barrel. Also in this variant, it is possible to provide that the intermediate ring 36 is fastened to the bottom of the drum, and the outer ring 38 is fastened to the plate, or that the intermediate ring 36 is fastened to the plate, and the outer ring 38 is fastened to the bottom.

Thus proposed is a timepiece whereof the various elements of the barrel are pivoted optimally, both in terms of guiding and the level of weakness of the friction. This is obtained without cluttering the plate around the barrel. Furthermore, the versions proposed in FIGS. 3-5, with the arbor 14 flying, are particularly advantageous in terms of thickness and friction.

The power reserve of such a barrel is improved, owing to its efficiency, which is greater than that of the state of the art. It is thus possible to use a weaker, and therefore thinner, spring to give the desired amplitude to the balance. The spring may therefore be wound over a larger number of revolutions in a same volume, and therefore store a greater amount of energy.

The invention claimed is:

1. A timepiece including a plate and a barrel mounted on an element of the frame, said barrel comprising a drum including a bottom and side walls, a barrel arbor passing through center of the drum and equipped with pivot means for pivoting on the element of the frame, a strip-spring housed in the drum and cooperating by a first end with the barrel arbor and by a second end with the drum, and a cover passed through by the barrel arbor and closing said drum, a ratchet wheel being kinematically connected to the barrel arbor for winding of said spring, wherein the barrel arbor is mounted flying so that the barrel arbor is only pivoted by one end of the barrel arbor, using a bearing including three coplanar rings, whereof one ring among the intermediate and outer rings is fastened to an element of the frame, the other ring among the intermediate and outer rings is fastened to the bottom of the drum, and the inner ring is fastened to the barrel arbor.

2. The timepiece of claim 1, wherein said element of the frame is a bridge.

3. The timepiece of claim 2, wherein said bridge is a barrel bridge.

4. The timepiece of claim 3, wherein the intermediate ring is fastened to the bottom, and the outer ring is fastened to the barrel bridge.

5. The timepiece according to claim 4, wherein said ratchet wheel is arranged on the side of a bridge opposite the barrel.

6. The timepiece of claim 3, wherein the intermediate ring is fastened to the barrel bridge and the outer ring is fastened to the bottom.

7. The timepiece according to claim 6, wherein said ratchet wheel is arranged on the side of a bridge opposite the barrel.

8. The timepiece according to claim 3, wherein said ratchet wheel is arranged on the side of a bridge opposite the barrel.

9. The timepiece according to claim 1, wherein said element of the frame is a plate.

10. The timepiece according to claim 9, wherein the intermediate ring is fastened to the bottom and the outer ring is fastened to the plate.

11. The timepiece according to claim 10, wherein the ratchet is mounted on the barrel arbor, on the plate side.

12. The timepiece according to claim 9, wherein the intermediate ring is fastened to the plate and the outer ring is fastened to the bottom.

13. The timepiece according to claim 12, wherein the ratchet is mounted on the barrel arbor, on the plate side.

14. The timepiece according to claim 9, wherein the ratchet is mounted on the barrel arbor, on the plate side.

15. The timepiece according to claim 1, wherein the inner ring, the intermediate ring and the outer ring are coplanar.

* * * * *